US005437559A

United States Patent [19]

Okumura et al.

[11] Patent Number: 5,437,559

[45] Date of Patent: Aug. 1, 1995

[54] ELECTRICAL CONNECTOR ASSEMBLY WITH AN IMPROVED OPERATING LEVER

[75] Inventors: Hitoshi Okumura; Yuichi Nankou, both of Yokkaichi, Japan

[73] Assignee: Sumitomo Wiring Systems, Ltd., Mie, Japan

[21] Appl. No.: 312,992

[22] Filed: Sep. 27, 1994

[30] Foreign Application Priority Data

Sep. 28, 1993 [JP] Japan ..... 5-265731

[51] Int. Cl.[6] ..... H01R 13/62

[52] U.S. Cl. ..... 439/310; 439/352; 439/372

[58] Field of Search ..... 439/136, 142, 144, 147, 439/157, 299, 310, 338, 347, 352, 372

[56] References Cited

U.S. PATENT DOCUMENTS 4,586,771 5/1986 Kraemer et al. ..... 439/310 X
4,884,978 12/1989 Inaba et al. .
5,183,408 2/1993 Hatagishi ..... 439/310 X
5,344,194 9/1994 Hatagishi et al. ..... 439/310 X

FOREIGN PATENT DOCUMENTS 3839728 10/1991 Germany .
1-137572 5/1989 Japan .

*Primary Examiner*—Khiem Nguyen
*Attorney, Agent, or Firm*—Wenderoth, Lind & Ponack

[57] ABSTRACT

An electrical connector assembly includes a male connector housing having shafts projecting from its opposite side walls respectively. A locking hood is mounted on the shafts to be rotatively moved about them between a lying state that it lies along the top of the male connector housing and a rising state relative to the top of the male connector housing. The locking hood has on its distal end a cam projection lifted up with insertion of a female connector housing into the male connector housing. In a temporary latching state of the connector housings, the cam projection is engaged with a cam block of the female connector housing so that the female connector housing is displaced. The rear end of the locking hood extends obliquely downwardly to provide an elastic member. When the locking hood is rotatively moved to rise up, the elastic member abuts against the top of the male connector housing to elastically deform, urging the locking hood to the former state. As a result, the locking hood can be prevented from becoming an obstacle in the storage of the connector assembly and can be prevented from easily dropping off.

8 Claims, 4 Drawing Sheets

ELECTRICAL CONNECTOR ASSEMBLY WITH AN IMPROVED OPERATING LEVER

BACKGROUND OF THE INVENTION

1. Field of the invention

This invention relates to an electrical connector assembly of the type that an operating lever is provided for the purpose of mating engagement of connectors.

2. Description of the prior art

The above-described type electrical connectors in which the principle of a lever is utilized for the mating engagement of the connectors are known in the art. An operating lever having a guide groove is rotatably mounted on either one of male and female connectors. A guide pin provided on the other connector is inserted into the guide groove. The operating lever is held in a rising state before the mating engagement of the connectors so that the guide pin is easily inserted into the guide groove when the connectors are mated with each other.

However, the operating lever is held in the rising state relative to the outer face of the connector housing in the above-described construction. Accordingly, since the operating levers sometimes become obstacles when the connectors are kept in storage facilities such as a stockroom, a storing efficiency of the storage facilities is lowered. Furthermore, the levers drop off when the operating levers come into contact with or collides with other objects during conveyance. To solve these problems, the prior art has proposed the construction that the operating lever be movable between a position at the time of the rising state and a position where the operating lever lies along the outer face of the connector housing during storage and conveyance. Even in the proposed construction, however, vibration or an external force during the conveyance causes the lever to easily move to the position of the rising state, resulting in dropout of the lever.

SUMMARY OF THE INVENTION

The present invention has been made in view of the foregoing problems and an object thereof is to provide an electrical connector assembly with an operating lever wherein the operating lever can be prevented from becoming an obstacle in the storage of the connector assembly and can be prevented from easily dropping off.

The present invention provides an electrical connector assembly comprising first and second connector housings fitted with each other. A pair of terminals are provided in the first and second connector housings respectively to be connected together when the first and second connector housing are fitted with each other. An operating lever is rotatably mounted on the first connector housing to be movable between a lying state in which the lever lies along an outer face of the first connector housing and a rising state in which the lever rises up relative to the outer face of the first connector housing. A cam block is provided in the second connector housing. A cam projection is provided on the operating lever for pushing the cam block of the second connector housing when the operating lever has been moved from the rising state to the lying state in the case where the first and second connector housings are fitted with each other, thereby displacing the second connector housing in a direction in which the first and second connector housings are fitted with each other. An elastic member is provided on either the operating lever or the first connector housing to be elastically deformed when the operating lever is moved from the lying state to the rising state to urge the operating lever so that the operating lever returns to the lying state.

According to the above-described construction, the operating lever is caused to lie along the outer face of the first connector housing during storage or conveyance. When the vibration or external force causes the operating lever to rise up, the elastic member of the first connector housing is elastically deformed to urge the operating lever to the former position. Consequently, the operating lever returns to the former position. Furthermore, when the first and second connector housings are mated together, the operating lever rises up into the rising state upon insertion of the second connector housing into the first connector housing. Then, when the operating lever is rotatively moved along the outer face of the first connector housing, the second connector housing is displaced by the cam projection in the mating direction and both connectors are mated together.

The electrical connector assembly may further comprise a latching projection provided on the first connector housing and a latching aperture formed in the operating lever to be engaged with the latching projection so that the operating lever is held in the lying state. In this case, the operating lever can be held in the lying state more reliably.

BRIEF DESCRIPTION OF THE DRAWINGS

Other objects, features and advantages of the present invention will become clear upon reviewing the following description of preferred embodiments thereof, made with reference to the accompanying drawings, in which.

DESCRIPTION OF THE PREFERRED EMBODIMENTS

Figure 4:
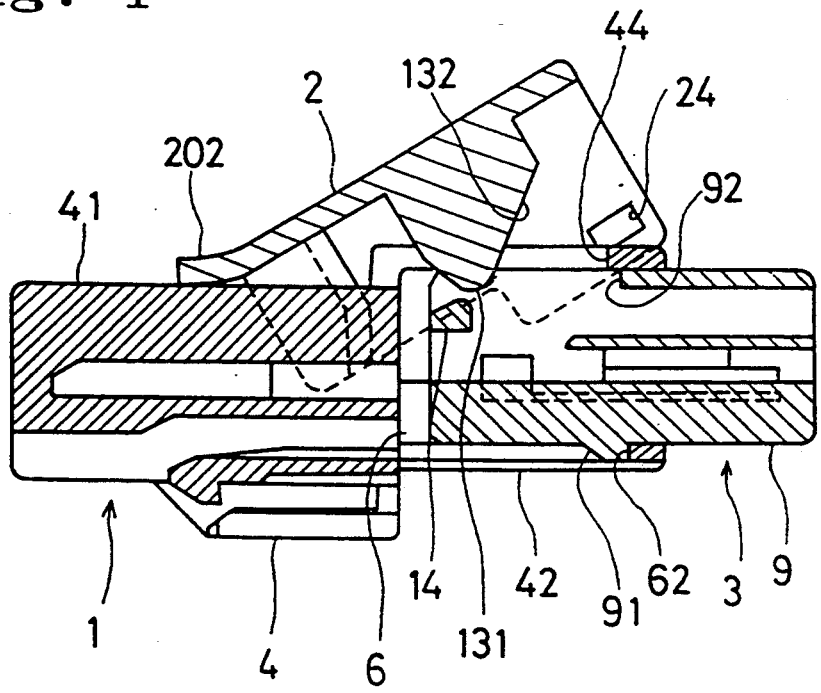
FIG. 4 is a longitudinal sectional view of the connector assembly, showing a temporary engagement state of the male and female connectors.
Figure 5:
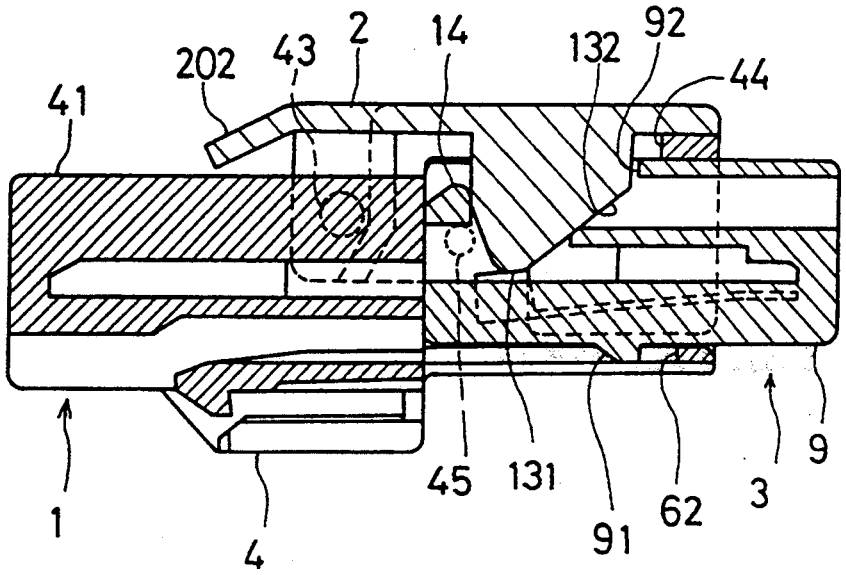
FIG. 5 is a longitudinal sectional view of the connector assembly, showing a regular engagement state of the male and female connectors.
Figure 6:
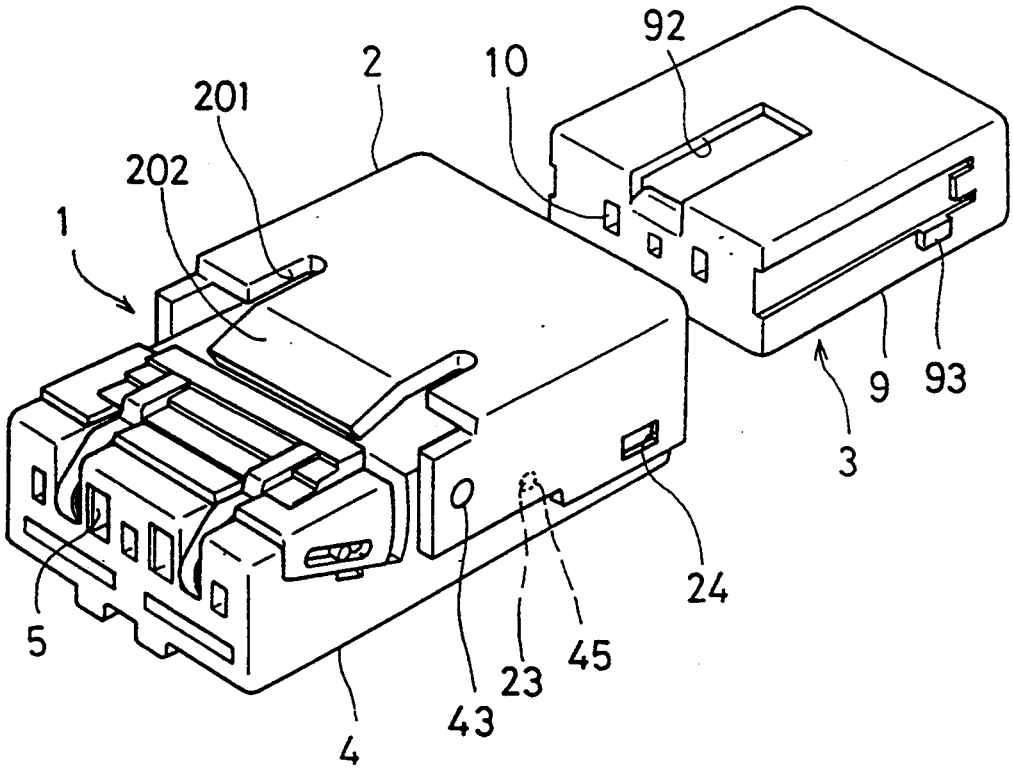
FIG. 6 is a perspective view of the connector assembly.

A first embodiment of the present invention will be described with reference to FIGS. 1 to 6. In the embodiment, a locking hood 2 serving as an operating lever is mounted on a male connector 1 as shown in FIG. 6. A female connector 3 is displaced from a temporary mating position to a regular mating position when the locking hood 2 is rotatively moved manually, so that the male and female connectors 1, 3 are mated together with the locking hood 2 being engaged with the female connector 3.

Figure 1:
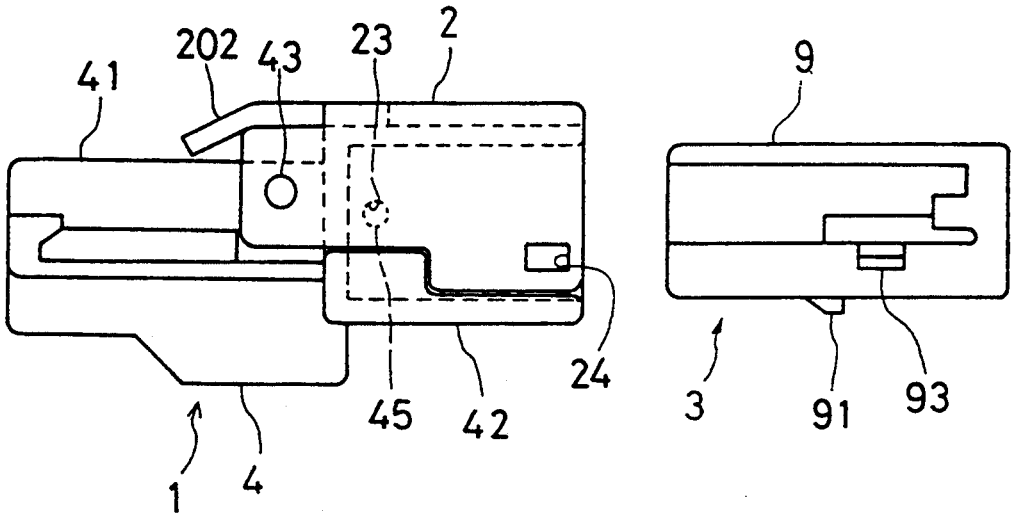
FIG. 1 is a side view of a first embodiment of an electrical connector assembly in accordance with the present invention.
Figure 2:
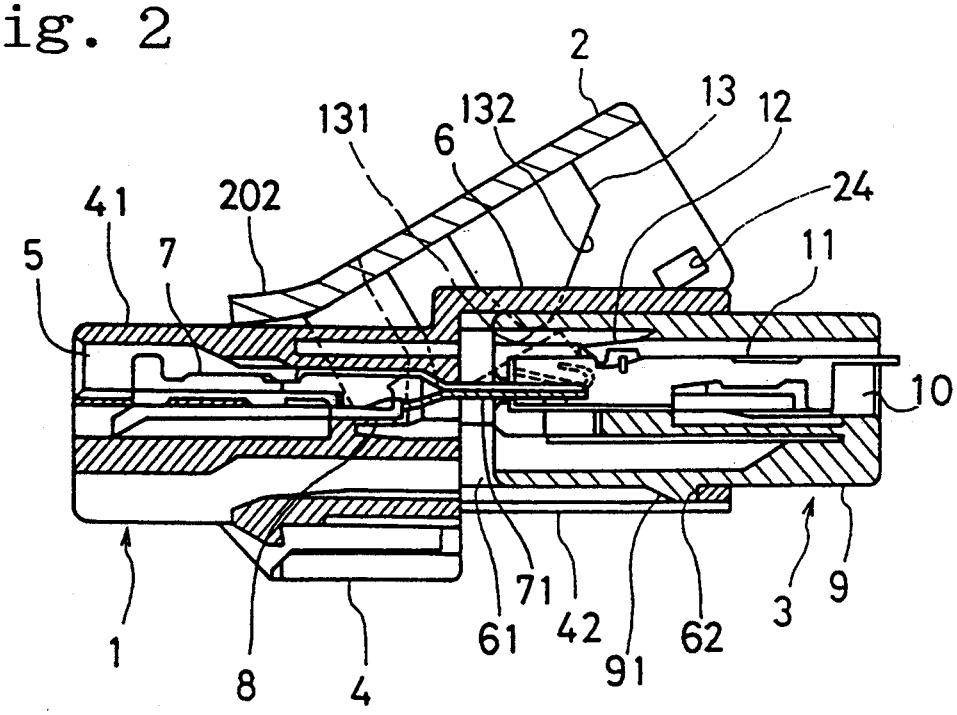
FIG. 2 is a longitudinal sectional view of the connector assembly, showing terminal cavities for accommodating male and female terminals respectively.
Figure 3:
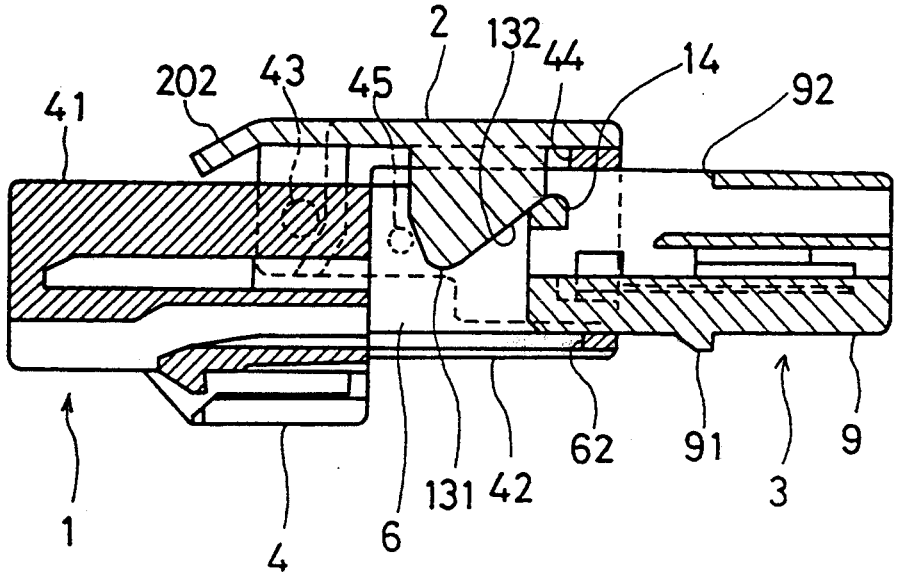
FIG. 3 is a longitudinal sectional view of the connector assembly, showing an initial stage of the mating engagement of the male and female connectors.

Referring now to FIGS. 1 and 2, the male connector 1 comprises a first or male connector housing 4 formed generally into the shape of a rectangular parallelepiped. The male connector housing 4 has a rear 41 (the left-hand portion in FIG. 1) and a front 42 (the right-hand portion in FIG. 1). A plurality of terminal cavities 5 for accommodating respective male terminals are defined by partition walls in the interior of the rear 41 of the male connector housing 4. An accommodating chamber 61 for accommodating the female connector 3 is defined by a rectangular hood 6 in the front 42 of the male connector housing 4. Male terminals 7 are accommodated in the terminal cavities 5 respectively. Each male terminal 7 has on a distal end thereof a slender flat tab 71 whose front half projects into the accommodating chamber 61 to be arranged in parallel to each other. A cantilevered lance 8 projects from an inner wall of each terminal cavity 5. Each male terminal 7 is engaged with the lance 8 to be held in position.

The female connector 3 also comprises a second or female connector housing 9 formed generally into the shape of a rectangular parallelepiped. A plurality of terminal cavities 10 for accommodating respective female terminals are defined in the interior of the female connector housing 9 in parallel to one another. Female terminals 11 are accommodated in the terminal cavities 10 respectively. The female terminals 11 are fitted with the male terminals 7 to be electrically connected to them respectively when the male and female connector housings 4, 9 are mated together. A cantilevered lance 12 projects from an inner wall of each terminal cavity 10 so that each female terminal 11 is engaged with the lance 12 to be held in position. The female connector housing 9 has a temporary latching claw 91 projecting from the underside thereof. The latching claw 91 is engaged with a temporary latching block 62 projecting from the inner bottom of the accommodating chamber 61 of the male connector 1 when the female connector 3 is inserted into the accommodating chamber 61. Consequently, both connectors 1, 3 are held in a temporary mating state.

The male connector housing 4 has a pair of shafts 43 projecting from the generally central portions of the right-hand and left-hand side walls thereof respectively. The locking hood 2 is rotatably mounted on the shafts 43. The locking hood 2 has a generally U-shaped section and covers the top, the right-hand and left-hand side walls of the front half of the male connector 1. The locking hood 2 is rotatively movable between a lying state that it lies along the top of the male connector housing 4 and a rising state relative to the top of the male connector housing 4. The locking hood 2 has a plate-like cam projection 13 projecting from the central inside of its upper wall. An inclined face 132 is formed to extend from a lower end of the cam projection 13 toward the distal end of the locking hood 2. The lower end of the cam projection 13 has a rounded corner. The accommodating chamber 61 of the male connector housing 4 has in the upper face a slit 44 through which the cam projection 13 extends. The female connector housing 9 has an insertion groove 92 formed in the front upper face thereof. The cam projection 13 extends through the slit 44 and invades the insertion groove 92 when the locking hood 2 is rotatively moved to lie along the top of the male connector housing 4, with both connector housings 4, 9 in the temporary mating state. The female connector housing 9 has a cam block 14 bridging both side walls defining the insertion groove 92, as shown in FIG. 4. The cam projection 13 collides with the cam block 14 with the rotative movement of the locking hood 2.

Referring to FIG. 6, two slits 201 are formed in the rear top of the locking hood 2 with a predetermined distance therebetween and extend toward the distal end of the locking hood 2. A portion of the rear top between the slits 201 extends obliquely downwardly to serve as an elastic member 202. When the locking hood 2 is rotatively moved upwardly, the lower end of the elastic member 202 abuts against the top of the male connector housing 4 to be elastically deformed, thereby urging the locking hood 2 downwardly. The accommodating chamber 61 of the male connector housing 4 has a pair of auxiliary latching projections 45 projecting from the outer faces of the right-hand and left-hand side walls thereof respectively. The locking hood 2 has two latching apertures 23 corresponding to the respective latching projections 45. The latching projections 45 are engaged with the respective latching apertures 23 when the locking hood 2 is in the lying state that it lies along the top of the male connector housing 4, as shown in FIG. 1. The locking hood 2 further has two regular latching apertures 24 formed in the right-hand and left-hand side walls thereof respectively. The female connector housing 9 has two regular latching projections 93 formed on the outer faces of the right-hand and left-hand side walls thereof respectively. When the male and female connectors 1, 3 have been mated together into the regular latching state, the regular latching projections 93 of the female connector housing 9 are engaged with the regular latching apertures 24 respectively so that both connectors are held in the regular mating state.

The operation of the connector assembly will be described. Before both connectors 1, 3 are mated together, the locking hood 2 lies along the top of the male connector housing 4 as shown in FIG. 1. The male connector 1 is thus rendered compact before the mating engagement. Accordingly, when a large number of male connectors 1 are accommodated in a container, for example, an accommodating efficiency of the container is at a high level.

When the male connectors 1 are conveyed in the container, the vibration or collision of one male connector with another sometimes causes a force applied to the locking hood 2 so that it rises up. If the locking hood 2 should be rotatively moved to rise up, it would hitch on or catch other male connectors 1 and would be further rotatively moved. The locking hood 2 would be rotatively moved over the limit of its allowed rotative movement and would eventually drop out of the male connector 1. In the embodiment, however, the latching projections 45 are in engagement with the respective latching apertures 23 when the locking hood 2 is lying along the top of the male connector housing 4. Accordingly, since the locking hood 2 is held in the lying state, the locking hood 2 is not rotatively moved easily even when the force causing the hood 2 to rise up is applied to the hood 2. Furthermore, even if the latching projections 45 are disengaged from the respective latching apertures 23 such that the rotative movement of the locking hood 2 starts, the lower end of the elastic member 202 of the locking hood 2 abuts against the top of the male connector housing 4 to be elastically deformed when the locking hood 2 has been rotatively moved slightly. Consequently, the locking hood 2 is urged in the opposite direction. The locking hood 2 is then caused to return to the former lying state. Thus, the locking hood 2 can be prevented from hitching on the other male connectors to be rotatively moved over the limit of its allowed rotative movement and can be accordingly prevented from dropping out of the male connector 1.

In mating both connectors 1, 3 together, the female connector 3 is inserted into the accommodating chamber 61 of the male connector 1. The cam block 14 lifts the cam projection 13 of the locking hood 2 upwardly with invasion of the female connector 3 into the chamber 61, so that the locking hood 2 is rotatively moved to rise up. At the same time, the elastic member 202 of the locking hood 2 abuts against the top of the male connector housing 4 to be elastically deformed such that the locking hood 2 is urged downwardly. The cam block 14 passes through the lower end 131 of the cam projection 13 when the temporary mating state is reached wherein the latching claw 91 of the female connector 3 is engaged with the latching block 62 of the accommodating chamber 61, as shown in FIG. 1. In this state, when the top of the locking hood 2 is pushed downwardly so that the locking hood 2 is rotatively moved, the cam projection 13 pushes the cam block 14, whereupon the male and female terminals 7, 11 are fitted with one another against the fitting resistance. The male and female connectors 1, 3 are thus mated together and assume the regular mating state as shown in FIG. 5. The regular latching projections 93 are then engaged with the respective regular latching apertures 24 so that the male and female connectors 1, 3 are held in the regular mating state. The elastic member 202 applies a spring force to the locking hood 2 in the above-described fitting process such that it is urged downwardly. Accordingly, the female connector 3 can be fitted with the male connector by application of a smaller force.

In the foregoing embodiment, the elastic member 202, the latching apertures 23 and the latching projections 45 are provided so that the locking hood 2 can be prevented from rising up easily when it is in the lying state. However, only the elastic member 202 can achieve the same effect and accordingly, the latching apertures 23 and the latching projections 45 may or may not be provided.

Figure 7:
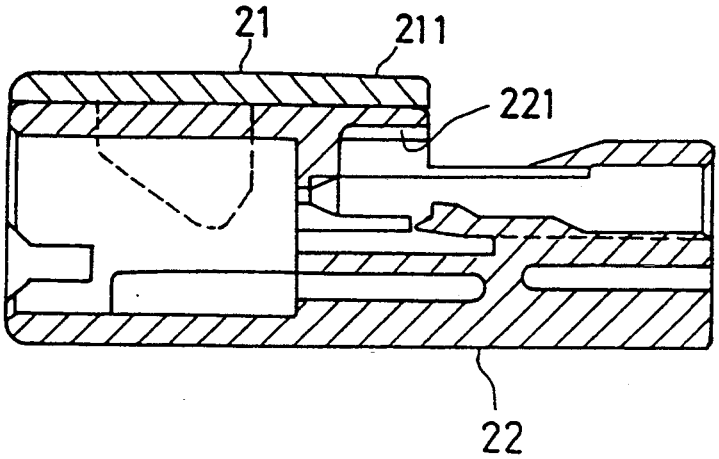
FIG. 7 is a longitudinal sectional view of a modified form of an electrical connector in accordance with the present invention.
Figure 8:
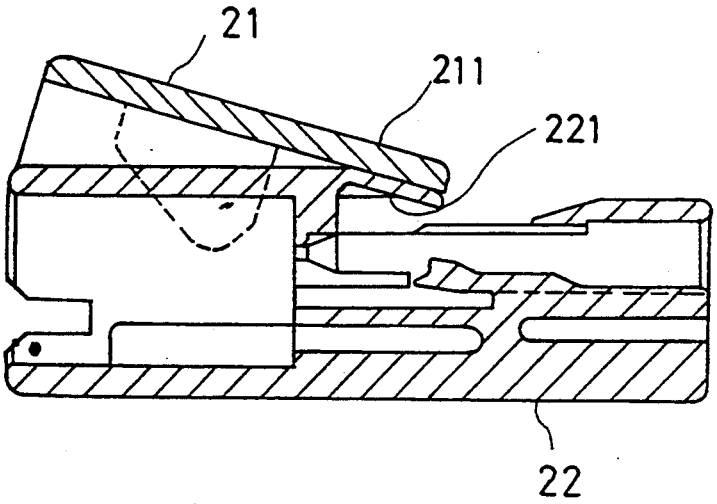
FIG. 8 is a longitudinal sectional view of the connector, showing an initial stage of the rising movement of a locking hood employed in the connector.
Figure 9:
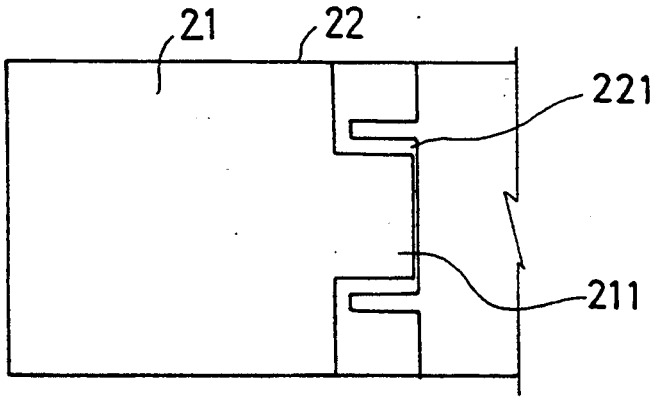
FIG. 9 is a plan view of the locking hood and elastic members formed in the male connector housing.

The elastic member 202 is formed by cutting out the rear end of the locking hood 2 in the foregoing embodiment. Alternatively, the elastic member 221 may be formed by cutting out the top of the male connector housing 22 and by slightly thinning the remaining portion between the cut portions, as shown as a modified form in FIGS. 7 and 9. In this modified form, too, the rear end 211 of the locking hood 21 abuts against the elastic member 221 so that the locking hood 21 is caused to return to the lying state, even if the force acts on the locking hood 21 to raise it up, as shown in FIG. 8. Consequently, the locking hood 21 can be prevented from being rotatively moved easily into the rising state and accordingly, it can be prevented from easily dropping out of the male connector.

The foregoing disclosure and drawings are merely illustrative of the principles of the present invention and are not to be construed in a limiting sense. Various changes and modifications will become apparent to those of ordinary skilled in the art. All such changes and modifications are seen to fall within the true spirit and scope of the invention as defined by the appended claims.

We claim:

1. An electrical connector assembly comprising:

a) first and second connector housings fitted with each other;

b) a pair of terminals provided in the first and second connector housings respectively to be connected together when the first and second connector housing are fitted with each other;

c) an operating lever rotatably mounted on the first connector housing to be movable between a lying state in which the lever lies along an outer face of the first connector housing and a rising state in which the lever rises up relative to the outer face of the first connector housing;

d) a cam block provided in the second connector housing;

e) a cam projection provided on the operating lever for pushing the cam block of the second connector housing when the operating lever has been moved from the rising state to the lying state in the case where the first and second connector housings are fitted with each other, thereby displacing the second connector housing in a direction in which the first and second connector housings are fitted with each other; and f) an elastic member provided on either the operating lever or the first connector housing to be elastically deformed when the operating lever is moved from the lying state to the rising state to urge the operating lever so that the operating lever returns to the lying state.

2. An electrical connector assembly according to claim 1, wherein the operating lever is formed into the shape of a hood having opposite side walls and covering a part of the first connector housing and the opposite side walls of the operating lever are rotatably mounted on respective shafts further mounted on the first connector housing.

3. An electrical connector assembly according to claim 1, further comprising a latching projection provided on the first connector housing and a latching aperture formed in the operating lever to be engaged with the latching projection so that the operating lever is held in the lying state.

4. An electrical connector assembly according to claim 2, wherein the hood-shaped operating lever has in one of two ends thereof a pair of slits each extending toward the other end thereof and the elastic member is formed integrally on the hood-shaped lever so that a portion of the elastic member located between the slits is extended.

5. An electrical connector assembly according to claim 1, wherein the cam projection of the operating lever has an inclined face formed on the side of a distal end of the operating lever so that the cam block of the second connector housing collides with the inclined face of the cam projection, thereby rotatively moving the operating lever in the direction that the operating lever rises up relative to the outer face of the first connector housing in the case where the second connector housing is inserted in a direction that the first and second connector housings are mated together when the operating lever is in the lying state.

6. An electrical connector assembly according to claim 1, further comprising a temporary latching block provided on the first connector housing and a temporary latching claw provided on the second connector housing to be engaged with the temporary latching block so that the second connector housing is held in a position where the cam projection of the operating lever is capable of abutting against the cam block of the second connector housing.

7. An electrical connector assembly according to claim 1, wherein the elastic member is formed integrally on the first connector housing.

8. An electrical connector assembly comprising:

a) first and second connector housings fitted with each other;

b) a pair of terminals provided in the first and second connector housings respectively to be electrically connected together when the first and second connector housings are fitted with each other;

c) an operating lever rotatably mounted on the first connector housing to be movable between a lying state in which the lever lies along an outer face of the first connector housing and a rising state in which the lever rises up relative to the outer face of the first connector housing, the operating lever being formed into the shape of a hood having opposite side walls and covering a part of the first connector housing and the opposite side walls of the operating lever are rotatably mounted on respective shafts further mounted on the first connector housing;

d) a cam block provided in the second connector housing;

e) a cam projection provided on the operating lever for pushing the cam block of the second connector housing when the operating lever has been moved from the rising state to the lying state in the case where the first and second connector housings are fitted with each other, thereby displacing the second connector housing in a direction in which the first and second connector housings are fitted with each other, the cam projection having an inclined face formed on the side of a distal end of the operating lever so that the cam block of the second connector housing collides with the inclined face of the cam projection, thereby rotatively moving the operating lever in the direction that the operating lever rises up relative to the outer face of the first connector housing in the case where the second connector housing is inserted in a direction that the first and second connector housings are mated together when the operating lever is in the lying state;

f) a temporary latching block provided on the first connector housing;

g) a temporary latching claw provided on the second connector housing to be engaged with the temporary latching block so that the second connector housing is held in a position where the cam projection of the operating lever is capable of abutting against the cam block of the second connector housing;

h) a latching projection provided on the first connector housing;

i) a latching aperture formed in the operating lever to be engaged with the latching projection so that the operating lever is held in the lying state; and j) an elastic member provided on either the operating lever or the first connector housing to be elastically deformed when the operating lever is moved from the lying state to the rising state to urge the operating lever so that the operating lever returns to the lying state, the elastic member being formed integrally on the hood-shaped lever so that a portion of the elastic member located between slits of the lever is extended.

* * * * *